US012610980B1

(12) United States Patent
Ormaza

(10) Patent No.: US 12,610,980 B1
(45) Date of Patent: Apr. 28, 2026

(54) MULTIPURPOSE SMOKING TOOL

(71) Applicant: GREEN STREET MONSTER, LLC, Winter Garden, FL (US)

(72) Inventor: Manuel Ormaza, Winter Garden, FL (US)

( * ) Notice: Subject to any disclaimer, the term of this patent is extended or adjusted under 35 U.S.C. 154(b) by 0 days.

(21) Appl. No.: 19/177,213

(22) Filed: Apr. 11, 2025

(51) Int. Cl.
*A24F 13/12* (2006.01)
*A24C 5/42* (2006.01)
*A24C 5/44* (2006.01)

(52) U.S. Cl.
CPC ..... *A24F 13/12* (2013.01); *A24C 5/42* (2013.01); *A24C 5/44* (2013.01)

(58) Field of Classification Search
None
See application file for complete search history.

(56) References Cited

U.S. PATENT DOCUMENTS 8,881,736 B2 11/2014 Hatcher et al.
11,178,905 B2 11/2021 Karim
2009/0183742 A1* 7/2009 Strasheim ..... A24F 13/26 131/248

* cited by examiner

*Primary Examiner* — Katherine A Will
(74) *Attorney, Agent, or Firm* — Sanchelima & Associates, P.A.; Christian Sanchelima; Jesus Sanchelima

(57) ABSTRACT

A multipurpose smoking tool including a holder assembly and a packer assembly. The holder assembly may include a body having a first end with at least one cutout for receiving smoking articles of various dimensions, and a second end configured to interface with the packer assembly. The first end may feature multiple cutouts to accommodate smoking articles of different diameters, and may include a slit formation providing flexibility to the cutouts. The holder assembly may further incorporate a tip rolling functionality at the second end through a specialized slit for paper insertion. The packer assembly may include an elongated body with a tapered first end for compressing smokable material, and a second end configured to detachably connect with the holder assembly. The detachable configuration may allow for independent use of each component or combined use as an integrated tool.

10 Claims, 5 Drawing Sheets

MULTIPURPOSE SMOKING TOOL

BACKGROUND OF THE INVENTION

1. Field of the Invention

The present invention relates to smoking accessories and, more particularly, to a multipurpose smoking tool that may include a detachable holder and packer assembly for smokable articles. The invention may provide an integrated solution for handling, packing, and preparing smoking articles of various dimensions including pre-rolled cones and joints.

2. Description of the Related Art

Several designs for smoking accessories have been designed in the past. None of them, however, include the unique combination of features that characterize the present invention.

Applicant believes that a related reference corresponds to the commercially available Blazy Susan Cone Packer and Holder. This product features a clip cone holder with a first end having a cutout for receiving a bottom end of a joint cone and a second end with a packer. However, this product does not offer detachable components, multiple cutouts for accommodating various sizes of smoking articles, or a slit for enhanced flexibility.

Applicant believes that another related reference corresponds to U.S. Pat. No. 8,881,736B2 issued to DeRosa et al. for "Cigar holder assembly." This reference discloses a two-piece holder featuring an expandable opening sized to receive and support numerous size cigars. The opening features ridge cuts that aid in holding a cigar in its desired position. However, this reference is specifically designed for cigars rather than pre-rolled cones or joints, and lacks the multipurpose functionality of the present invention, including the detachable packer and tip rolling features.

Applicant also believes that U.S. Pat. No. 11,178,905B2 issued to Karim for "System for rolling and filling cigarettes with smokable material" is another related reference. This reference describes an apparatus and method for forming a tube of planar material suitable for use as a casing for a cigarette, incorporating a cone disposed within an interior chamber of a housing. However, this system is focused on the mechanical process of rolling and filling cigarettes, rather than providing a versatile tool for handling various dimensions of pre-rolled smoking articles.

Finally, Applicant believes that KR20150002975U to Suh for "Cigarette holder" is another related reference. This reference describes a cigarette holder made of an elastic material that includes a body and a clamp unit with a cigarette support hole. While this holder is designed to prevent odor transfer to the smoker's hand, it lacks the multipurpose functionality, detachable components, and adaptability for different sizes that characterize the present invention.

Other documents describing the closest subject matter provide for a number of more or less complicated features that fail to solve the problem in an efficient and economical way. None of these patents suggest the novel features of the present invention.

While these prior art devices fulfill their respective objectives, they do not describe a multipurpose smoking tool with the unique combination of a detachable holder and packer assembly, where the holder features multiple cutouts with a slit formation for flexible adaptation to different sized smoking articles, and incorporates a tip rolling functionality. The present invention offers distinct advantages over the prior art by integrating multiple functions into a single, versatile tool, eliminating the need for separate accessories and providing a comprehensive solution for handling, packing, and preparing smoking articles of various dimensions.

SUMMARY OF THE INVENTION

It is one of the objects of the present invention to provide a multipurpose smoking tool with detachable components that may integrate multiple functionalities into a single device.

It is another object of this invention to provide a smoking tool with a holder assembly that may accommodate smoking articles of various dimensions through multiple cutouts and a flexible slit formation.

It is still another object of the present invention to provide a smoking tool with a detachable packer assembly that may efficiently compress smokable material within cones and joints.

It is yet another object of this invention to provide a smoking tool with a tip rolling functionality that may facilitate the preparation of rolled smoking articles.

It is a further object of the present invention to provide a design that may be reconfigurable to adapt to different user preferences and smoking article sizes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
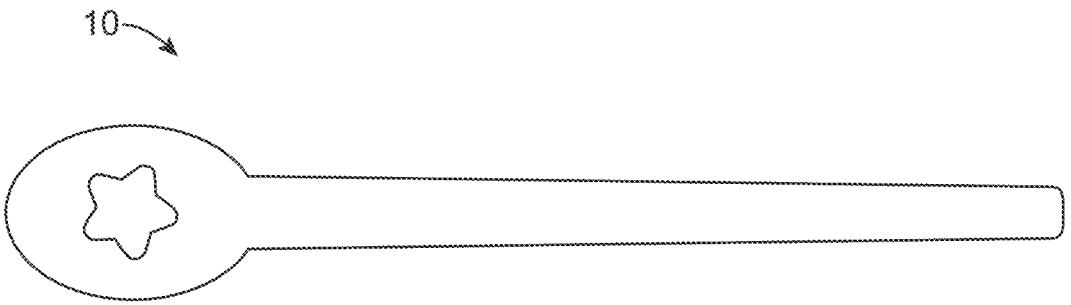
FIG. 1 represents a top planar view of the present invention.
Figure 2:
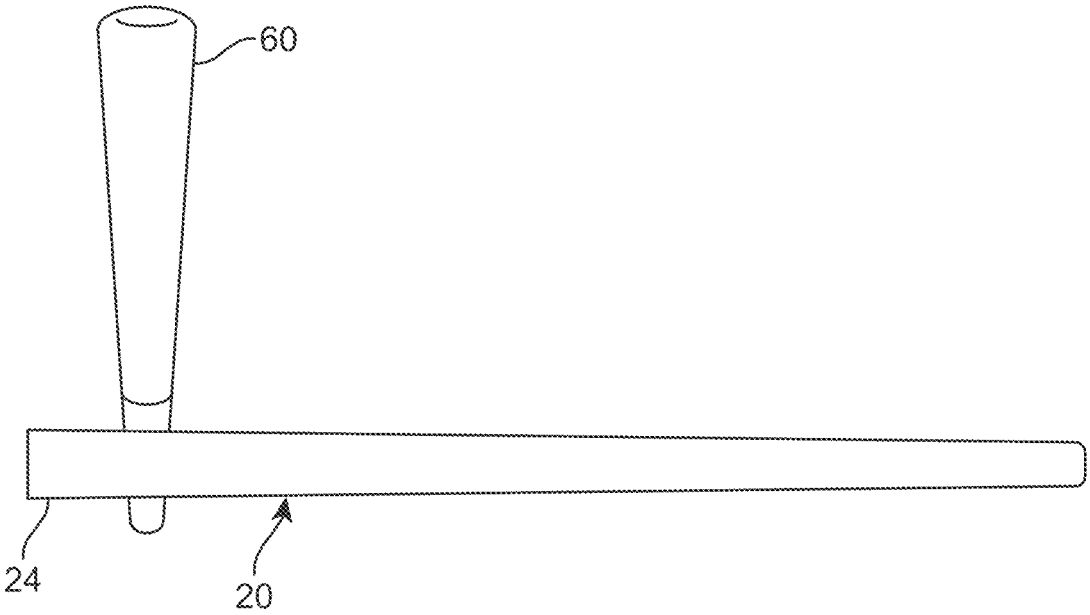
FIG. 2 shows a side operational view of the present invention according to an embodiment thereof.
Figure 3:
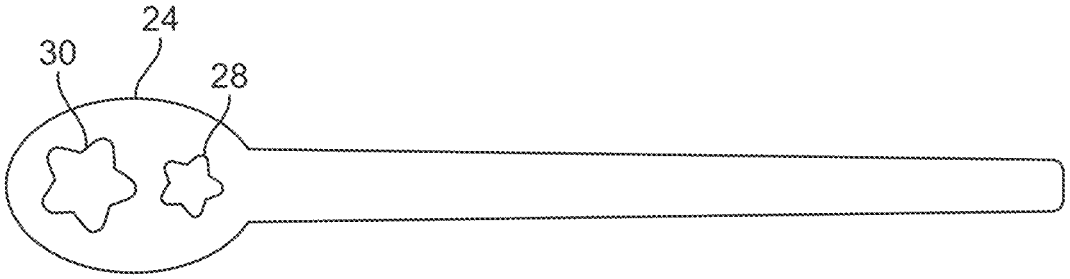
FIG. 3 illustrates a top planar view of the present invention, according to an embodiment thereof.
Figure 4:
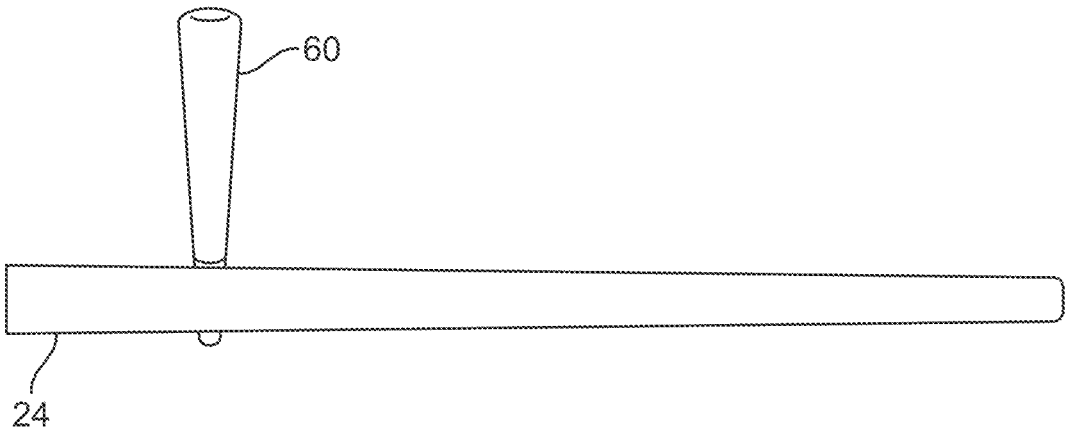
FIG. 4 is a representation of the embodiment of FIG. 3 in operational conditions.
Figure 5:
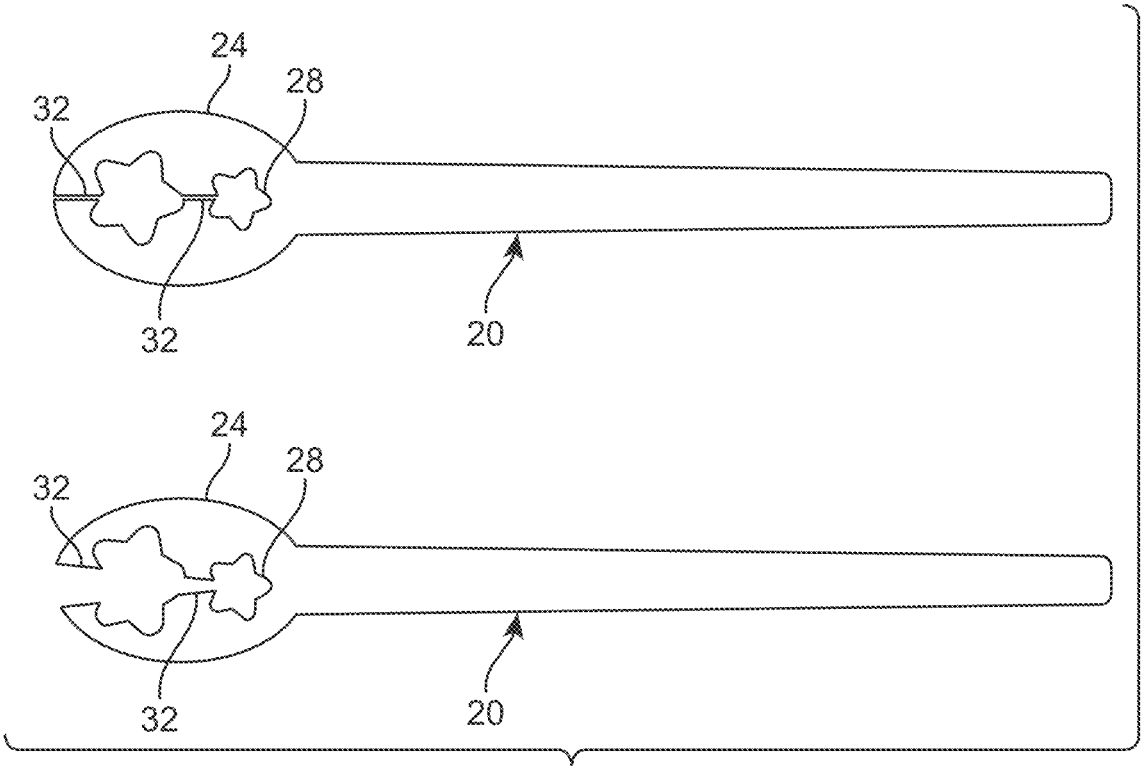
FIG. 5 shows the present invention in two operational states.
Figure 6:
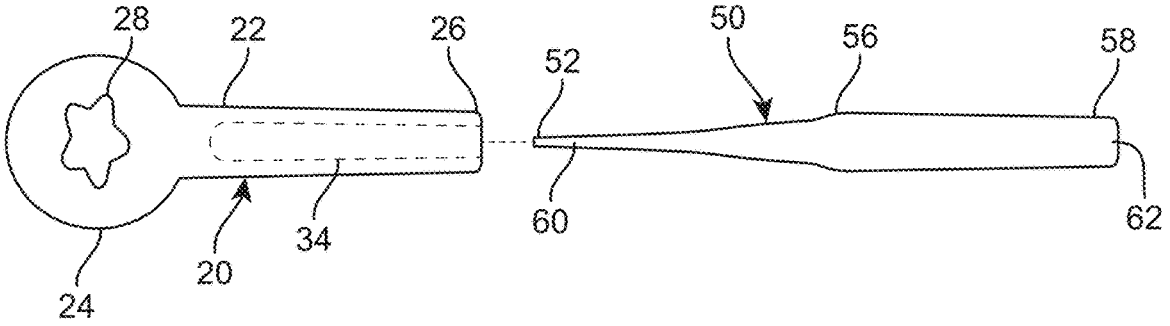
FIG. 6 illustrates an exploded view of the present invention, according to an embodiment thereof.
Figure 7:
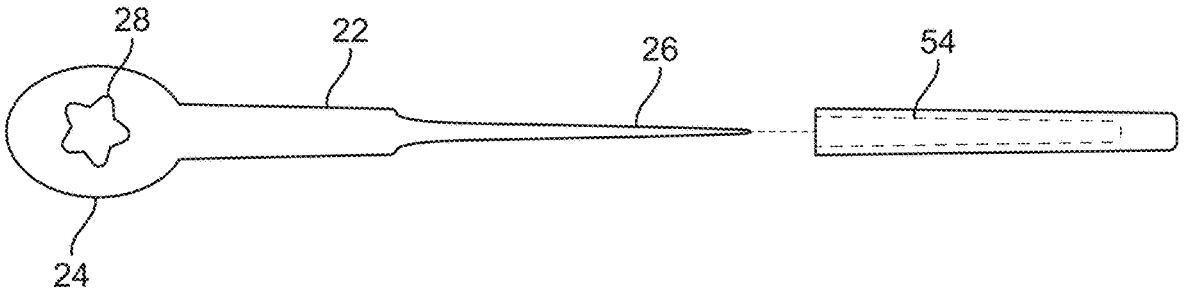
FIG. 7 represents an exploded view of the present invention, according to an exemplary embodiment thereof.
Figure 8:
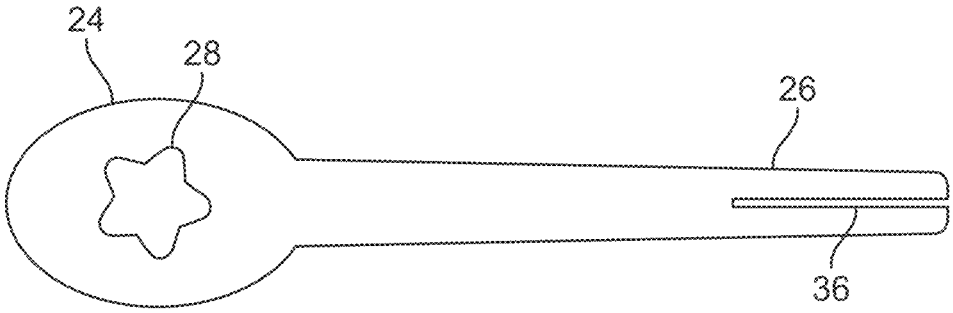
FIG. 8 shows an exemplary embodiment of the present invention.
Figure 9:
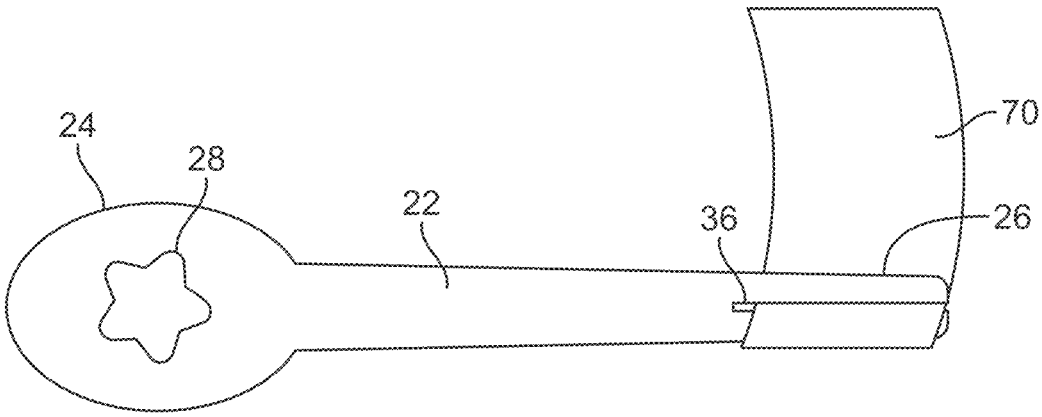
FIG. 9 shows the exemplary embodiment of FIG. 8 in operational conditions.

Referring now to the drawings, where the present invention is generally referred to with numeral 10, it can be observed that it basically includes a holder assembly 20 and a packer assembly 50. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The holder assembly 20 may include a body 22 having a first end 24 and a second end 26. The first end 24 may include at least one cutout 28 specifically designed to receive and support smoking articles 60 of various dimensions, such as pre-rolled cones or joints. As shown in FIG. 1, in a preferred embodiment, the first end may have a circular shape, wherein the cutout 28 may be included at the center thereof. In an alternative embodiment, the first end 24 may feature multiple cutouts, embodied as 28, 30 of different dimensions to accommodate smoking articles of varying diameters. It should be noted that more than two cutouts may be incorporated in the first end 24, depending on operational conditions and/or design requirements. The first end 24 may further include a slit 32 extending from the cutout 28 toward the body 22, providing enhanced flexibility to the cutout area. When the holder assembly 20 features two or more cutouts, the slit 32 may extend through each of the cutouts. This slit 32 may allow the cutout 28 to expand and contract, enabling a secure grip on smoking articles of different sizes. The flexibility provided by slit 32 may ensure that pre-rolled cones and joints of varying diameters may be securely held without risk of falling out or being damaged.

The second end 26 of the holder assembly 20 may be configured in different ways depending on the embodiment. In a first embodiment, the second end 26 may be hollow, forming a cavity 34 sized to receive a tapered end 52 of the packer assembly 50, commonly termed as picker. In a second embodiment, the second end 26 may itself be tapered, thereby defining a picker, to interface with a hollow end 54 of the packer assembly 50. The connection between the holder assembly 20 and packer assembly 50 may be achieved through various attachment mechanisms, including but not limited to pressure fitting, threaded engagement, snap-on connections, or magnetic coupling.

In a third embodiment, the second end 26 of the holder assembly 20 may incorporate a tip rolling functionality. This may include a slit 36 specifically designed to facilitate paper insertion and twist-rolling operations 70. The slit 36 may allow a user to insert a flat paper tip, which may then be twisted to form a rolled tip. The rolled tip may subsequently serve as the foundation for rolling a complete cone. This feature may eliminate the need for separate rolling tools, thus enhancing the multipurpose nature of the invention.

The packer assembly 50 may include an elongated body 56 having a first end 58 and a second end 60. In various embodiments, the first end 58 may be tapered to form a packing tip 62 designed for efficiently compressing smokable material within a cone or joint. The second end 60 may either be hollow to receive the tapered second end 26 of the holder assembly 20 as described above, or it may be tapered, thereby defining 52, to be inserted into the cavity 34 of the holder assembly 20, depending on the specific embodiment.

In a further embodiment, the elongated body 56 of the packer assembly 50 may incorporate a picker function (52) at an end opposite to the packing tip 62. This picker function may be achieved through a narrow, elongated extension suitable for manipulating smokable material with precision.

The holder assembly 20 and packer assembly 50 may be detachably connected, allowing users to utilize each component separately as needed, or together as a unified tool. When attached, the combined tool may provide an integrated solution for handling, packing, and preparing smoking articles. When detached, each component may be used independently, offering flexibility based on the user's specific needs at any given time.

Both the holder assembly 20 and packer assembly 50 may be constructed from a variety of materials, including but not limited to various plastics, wood, metal, aluminum, alloys, or silicone. The material selection may be based on considerations of durability, flexibility where needed, and overall user experience. The components may be manufactured through various processes, including molding, casting, machining, or 3D printing, depending on the selected materials and desired production volume.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A roach clip configured with a picker and packer, comprising:

a) a holder assembly having a body with a first end and a second end, said first end having at least one cutout configured to receive a smoking article; and b) a packer assembly having an elongated body with a first end and a second end, said first end having a tapered packing tip;

c) wherein said holder assembly and said packer assembly are detachably connected to each other; wherein said second end of said holder assembly is tapered and configured to be received by a hollow portion of said packer assembly.

2. The roach clip configured with a picker and packer of claim 1, wherein said first end of said holder assembly has a circular shape and includes a plurality of cutouts of different dimensions aligned at a center thereof, configured to accommodate smoking articles of varying diameters.

3. The roach clip configured with a picker and packer of claim 1, wherein said first end of said holder assembly further includes a slit extending from said at least one cutout toward said body, said slit configured to provide flexibility to said cutout.

4. The roach clip configured with a picker and packer of claim 1, wherein said second end of said holder assembly includes a slit configured for paper insertion and twist-rolling operations.

5. A roach clip configured with a picker and packer, comprising:

a) a holder having a body with a first end and a second end, wherein said first end has at least one cutout configured to secure a smoking article;

b) wherein said second end of said holder is hollow to form a cavity sized to receive a tapered end of a packer therein.

6. The roach clip configured with a picker and packer of claim 5, wherein said first portion of said holder component includes multiple cutouts of different sizes configured to accommodate smoking articles of different diameters.

7. The roach clip configured with a picker and packer of claim 6, wherein said first portion of said holder component further includes a slit extending from at least one of said multiple cutouts, said slit configured to provide flexibility to said cutouts.

8. The roach clip configured with a picker and packer of claim 5, wherein said second end of said holder includes a horizontal slit configured to receive and secure a paper sheet for forming a cone.

9. The roach clip configured with a picker and packer of claim 5, wherein said second end is tapered, thereby defining a picker.

10. A roach clip configured with a picker and packer, consisting of:

a) a holder member having a body with a first end, a second end, and a central axis, said first end including a plurality of cutouts of different dimensions arranged around said central axis and a slit extending from at least one of said plurality of cutouts toward said body; and b) a packer member having an elongated body with a first end forming a packing tip and a second end, said packer member being detachably connected to said holder member;

c) wherein said holder member and said packer member are configured to be used together as an integrated unit or separately as independent tools.

* * * * *